US005551261A

United States Patent [19]

Lyu et al.

[11] Patent Number: 5,551,261

[45] Date of Patent: Sep. 3, 1996

[54] AUTOMATIC WASHING MACHINE AND METHOD FOR CONFIRMATION OF CLUTCHING OPERATION THEREOF

[75] Inventors: Jae C. Lyu; Chang S. Kang, both of Kyungki-do; Gwan R. Park; Kyeong H. Kim, both of Seoul, all of Rep. of Korea

[73] Assignee: Goldstar Co., Ltd., Seoul, Rep. of Korea

[21] Appl. No.: 207,415

[22] Filed: Mar. 8, 1994

[30] Foreign Application Priority Data

| | | | |
|---|---|---|---|
| Mar. 9, 1993 | [KR] | Rep. of Korea | 3531/1993 |
| May 8, 1993 | [KR] | Rep. of Korea | 7294/1993 |
| Aug. 27, 1993 | [KR] | Rep. of Korea | 16813/1993 |

[51] Int. Cl.[6] ..... D06F 23/04; D06F 37/40

[52] U.S. Cl. ..... 68/23.6

[58] Field of Search ..... 68/23.6, 23.7

[56] References Cited

U.S. PATENT DOCUMENTS

| | | | |
|---|---|---|---|
| 2,665,576 | 1/1954 | Thiele | 68/23.7 X |
| 4,741,183 | 5/1988 | Smith et al. | 68/23.7 |
| 4,813,248 | 3/1989 | Smith et al. | 68/23.7 |
| 4,853,571 | 8/1989 | Smith et al. | 310/90 |

*Primary Examiner*—Philip R. Coe
*Attorney, Agent, or Firm*—Fish & Richardson PC

[57] ABSTRACT

An automatic washing machine and a method for confirmation of a washing machine clutching operation which achieves the desired mode conversion between a washing mode and a dehydrating mode by ascending and descending its inner tub. The washing machine includes an outer tub, a perforated movable inner tub, a buoyancy generator for lifting the inner tub in accordance with a water level in the outer tub, a motor mounted on the outer bottom center of the outer tub, a rotator mounted on a top end of the motor shaft, and a clutching unit for selectively coupling the inner tub to either the outer tub or the rotator according to the position of the inner tub ascending and descending under the guide of the motor shaft. To confirm the clutching operation, a driving time or a driving stop time of the motor is counted and compared with a predetermined reference time.

9 Claims, 10 Drawing Sheets dehydrating mode washing mode neutral position

AUTOMATIC WASHING MACHINE AND METHOD FOR CONFIRMATION OF CLUTCHING OPERATION THEREOF

BACKGROUND OF THE INVENTION

The present invention relates in general to an automatic washing machine and, more particularly, to an automatic washing machine and a clutching confirmation method thereof wherein a washing and dehydrating tub changes its position between the washing and dehydrating mode positions while ascending and descending in an axial direction of a drive motor by buoyancy and its own weight.

As well known to those skilled in the art, a typical automatic washing machine includes a drive motor and a clutch which are placed at the outside of the lower section of an outer tub and connected to each other by a transmission V-belt. The washing machine also includes a washing shaft and a dehydrating shaft either of which shafts is applied with the rotational force of the drive motor under the clutching operation of the clutch to be rotated, thus to achieve a desired washing operation or a desired dehydrating operation.

With reference to FIG. 1, there is shown an example of the typical automatic washing machine. The washing machine includes a washing and dehydrating tub or an inner tub 12 which is placed in an outer tub 11 such that it is rotated by the rotational force of a drive motor 13.

Here, the drive motor 13 is placed at the outside of the lower section of the outer tub 11 and connected to a clutch assembly 16 by a transmission V-belt 14, which is wrapped about a motor pulley and a clutch pulley, as described above.

The automatic washing machine further includes two types of shafts, that is, a dehydrating shaft 19, which comprises upper and lower dehydrating shafts 19 and 21, and a washing shaft 27. The dehydrating shaft 19 and 21 and the washing shaft 27 coaxially extend from the clutch assembly 16 and are coupled to the inner tub 12 and a rotator 15, respectively. Here, the rotator 15 will be a pulsator or an agitator in accordance with the type of the washing machine.

FIG. 2 is an enlarged sectional view showing a construction of the clutch assembly 16. In this clutch assembly 16, a spring block 18 is fixed to a lower section of a gear shaft 17 and directly applied with the rotational force of the drive motor 13 through the V-belt 14.

A clutch spring 22 is mounted about the lower dehydrating shaft 21 which is integrally formed with both the upper dehydrating shaft 19 and a brake drum and gear housing 20. This clutch spring 22 controls the rotational force of the drive motor 13 transmitted to the clutch assembly 16 during the washing operation of the washing machine.

In order to apply a predetermined pressure to the outer surface of the brake drum and gear housing 20, a brake band 29 is wrapped about the brake drum and gear housing 20.

The clutch assembly 16 also includes a clutch boss 23 which is provided with teeth 23*a* at its circumferential surface and coupled to the outer surface of the clutch spring 22. In addition, a clutch boss cam 25 is rotatably mounted on a lower end of a brake lever 24.

The brake lever 24 is placed at a predetermined position where it is engaged with the teeth 23*a* of the clutch boss 23 and cooperates with a drain valve operating solenoid (not shown) which is mounted on a side of the outer tub 11.

In order to prevent reverse rotation of the inner tub 12, the clutch assembly 16 includes an one way spring clutch 26.

A planet gear 28 is provided in the clutch assembly 16 for reduction of the rotational force of the gear shaft 17 prior to transmission of this rotational force to the washing shaft 27.

In the case of the washing mode of this typical automatic washing machine, the clutch is in a non-clutched state, so that only the rotator 15 is alternately rotated in opposed directions while the-inner tub 12 is stopped. However, in the case of the dehydrating mode of the washing machine, the clutch is in a clutched state, so that the rotator 15 and the inner tub 12 are simultaneously rotated at the same high rotational speed.

Hereinbelow, the operations of the typical washing machine in the washing mode and dehydrating mode will be described in detail.

In the washing mode of the washing machine, the forward rotational force of the drive motor 13 is transmitted to the clutch assembly 16 through the V-belt 14 wrapped about the clutch pulley. In this case, the clutch pulley is rotated in the forward direction and this forward rotation of the pulley makes the clutch spring 22 be tightened, thus to transmit the rotational force of the drive motor 13 to the lower dehydrating shaft 21 through the spring block 18.

However, the teeth 23*a* of the clutch boss 23 on the outer surface of the clutch spring 22 push the clutch boss cam 25 and prevent tightening of the clutch spring 22, thereby causing no rotational force of the motor 13 to be transmitted to the upper dehydrating shaft 19.

At this time, the rotational force of the motor transmitted to the gear shaft 17 is reduced by the planet gear 28 and, thereafter, transmitted only to the washing shaft 27.

Only the rotator 15 coupled to the washing shaft 27 is thus rotated in order to achieve the desired washing operation.

Meanwhile, the reverse rotational force of the drive motor 13 in the washing mode is transmitted to the clutch assembly 16 through the V-belt 14 in the same manner as described for the above forward rotational force. In this case, the clutch pulley is rotated in the reverse direction and this makes the clutch spring 22 be loosened, thus to cause the rotational force of the gear shaft 17 not to be transmitted to the dehydrating shaft 19 but to washing shaft 27 through the planet gear 28. At this time, the rotational force is reduced by the planet gear 28 prior to its transmission to the washing shaft 27.

When the rotational force of the gear shaft 17 is reduced by the planet gear 28, there is generated a reaction torque in the gear housing 20, so that the upper dehydrating shaft 19 may be rotated in reverse direction.

However, this reverse rotation of the dehydrating shaft 19 is reliably prevented by both the one way spring clutch 26 and the brake band 29 wrapped about the brake drum and gear housing 20.

In the dehydrating mode of the washing machine, the forward rotational force of the drive motor 13 is transmitted to the clutch assembly 16 through the V-belt 14 wrapped about the clutch pulley. In this case, the clutch pulley is rotated in the forward direction and this forward rotation of the pulley makes the clutch spring 22 be tightened, thus to turn on the drain valve operating solenoid (not shown) and to pull a lever 30.

The clutch spring 22 thus comes into close contact with the spring block 18, and the clutch boss cam 25 of the brake lever 24 cooperating with the lever 30 is separated from the teeth 23*a* of the clutch boss 23 and, at the same time, the brake band 29 is released from the outer surface of the gear housing 20. Therefore, the rotational force of the spring block 18 is transmitted to the lower dehydrating shaft 21 of the gear housing 20 and rotates the upper dehydrating shaft 19, integrally formed with the gear housing 20, at a high speed without speed reduction. The inner tub 12 and the rotator 15, which are coupled to the dehydrating shaft 19 and the washing shaft 27 respectively, are thus rotated at the high speed, thereby achieving the desired dehydrating operation.

When the desired dehydration is finished or the dehydration mode of the washing machine is canceled, the drain valve operating solenoid is turned off.

Upon turning off the drain valve operating solenoid, the pulled lever 30 is released from its pulled state, and the clutch boss cam 25 is engaged with the teeth 23*a* of the clutch boss 23. At the same time, the brake band 29 is tightened on the outer surface of the gear housing 20, thus to cause the washing machine to be converted in its mode into the washing mode. The rotation of the brake drum and gear housing 20 is thus stopped.

Accordingly, the inner tub 12 coupled to the dehydrating shaft 19 and to the gear housing 20 is stopped in order to end the operation of the washing machine.

As described above, the typical automatic washing machine should have a complex clutch assembly for selective transmission of the rotational force of the drive motor to the inner tub in accordance with the operational mode of the washing machine. Hence, the washing machine is apt to be broken down in parts of its complex clutch. In addition, the provision of the clutch assembly causes generation of vibration and power loss in selective transmission of the rotational force of the drive motor to the washing shaft or to the dehydrating shaft.

SUMMARY OF THE INVENTION

It is, therefore, an object of the present invention to provide an automatic washing machine in which the aforementioned problem can be overcome and which achieves the desired mode conversion between a washing mode and a dehydrating mode by ascending and descending of its inner tub. The drive motor is mounted on the outer bottom center of the outer tub, to achieve the desired structural stability.

It is another object of the present invention to provide a method for confirmation of a clutching operation of the above automatic washing machine.

In one embodiment, the present invention provides an automatic washing machine comprising: An outer tub for containing washing water therein. A movable inner tub for washing and dehydration; the inner tub being movably concentrically placed in the outer tub in order to ascend and descend and having a plurality of perforations on its side wall. Means for generating buoyancy in accordance with water level of washing water charged in the outer tub; the buoyancy being applied to the inner tub in order to cause this inner tub to ascend. A shaft rotatably penetrating bottom centers of both the outer tub and the inner tub and guiding the ascending and descending of the inner tub. A motor for generating a rotational force for rotating the shaft. A rotator for generating a water current using the rotational force of the motor; the rotator being mounted on a top end of the shaft. And a clutching means for selectively coupling the inner tub to one of the outer tub and the rotator in accordance with position of the inner tub ascending and descending under the guide of the shaft.

The present invention also provides a method for confirmation of tub clutching operation of an automatic washing machine comprising the steps of: Driving the motor and counting a driving time of the motor while applying a predetermined reference voltage to the motor when a predetermined water level of washing water has been achieved. Determining whether a rotational speed of the motor has reached a reference speed. Stopping the counting of the driving time of the motor and the applying of reference voltage to the motor when the rotational speed of the motor has reached the reference speed. Comparing the counted driving time with a reference time, and confirming a dehydrating mode, wherein the rotator and the inner tub have been coupled to each other in order to be rotated together, when determining the counted time longer than the reference time. However, confirming a washing mode, wherein the inner tub has been coupled to the outer tub and only the water current generating means is rotated, when determining the counted time shorter than the reference time.

BRIEF DESCRIPTION OF THE DRAWINGS

Other objects and-aspects of the invention will become apparent from the following description of embodiments with reference to the accompanying drawings in which:

FIGS. 6*a* to 6*c* are views showing tooth engaging states of operational modes of the washing machine of FIG. 3, respectively, in which:

FIG. 6*a* shows a neutral mode;

FIG. 6*b* shows the washing mode; and

FIG. 6*c* shows the dehydrating mode;

DESCRIPTION OF THE PREFERRED EMBODIMENTS

Figure 1:
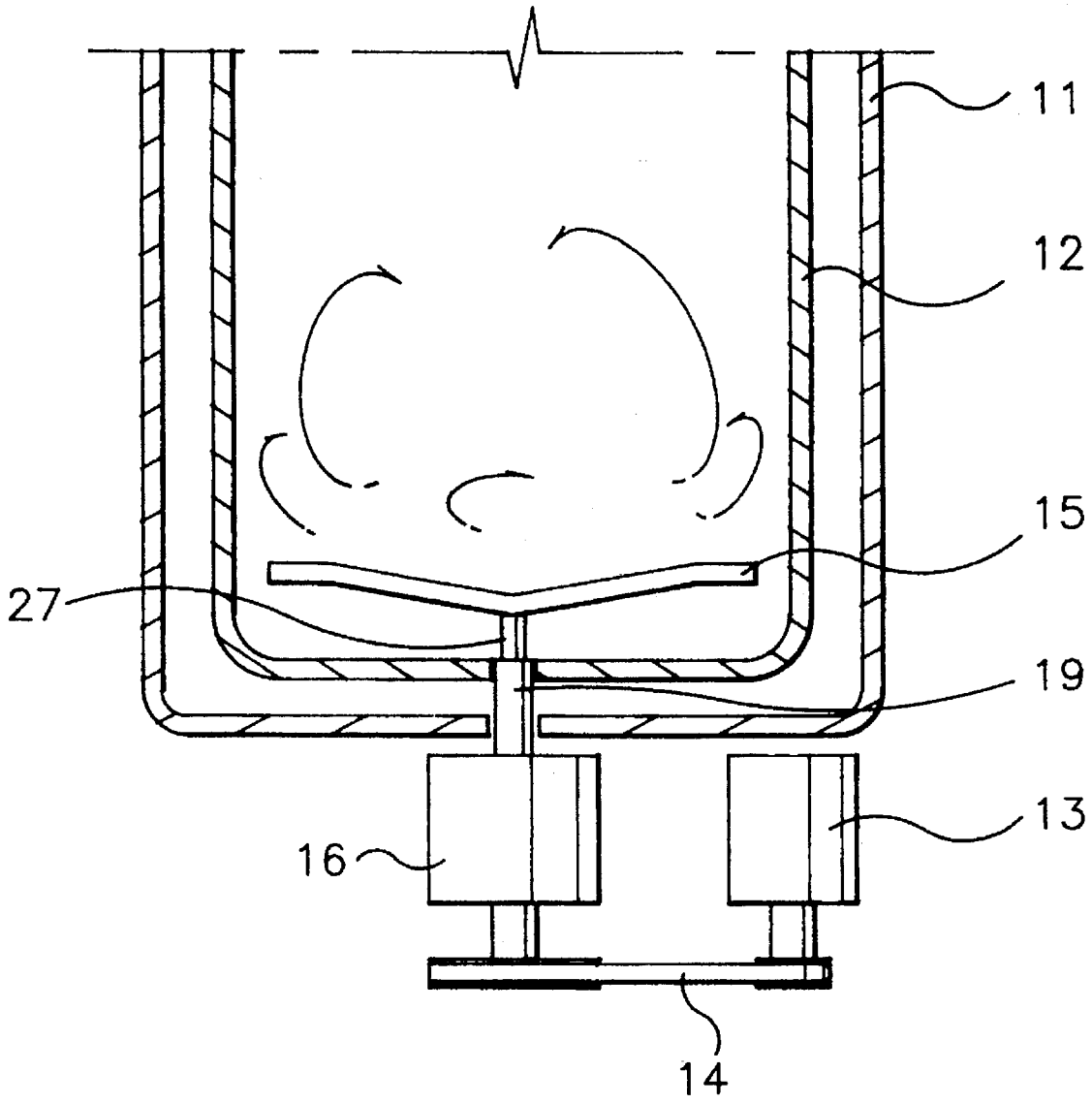
FIG. 1 PRIOR ART
FIG. 1 is a schematic view of a typical automatic washing machine.
Figure 2:
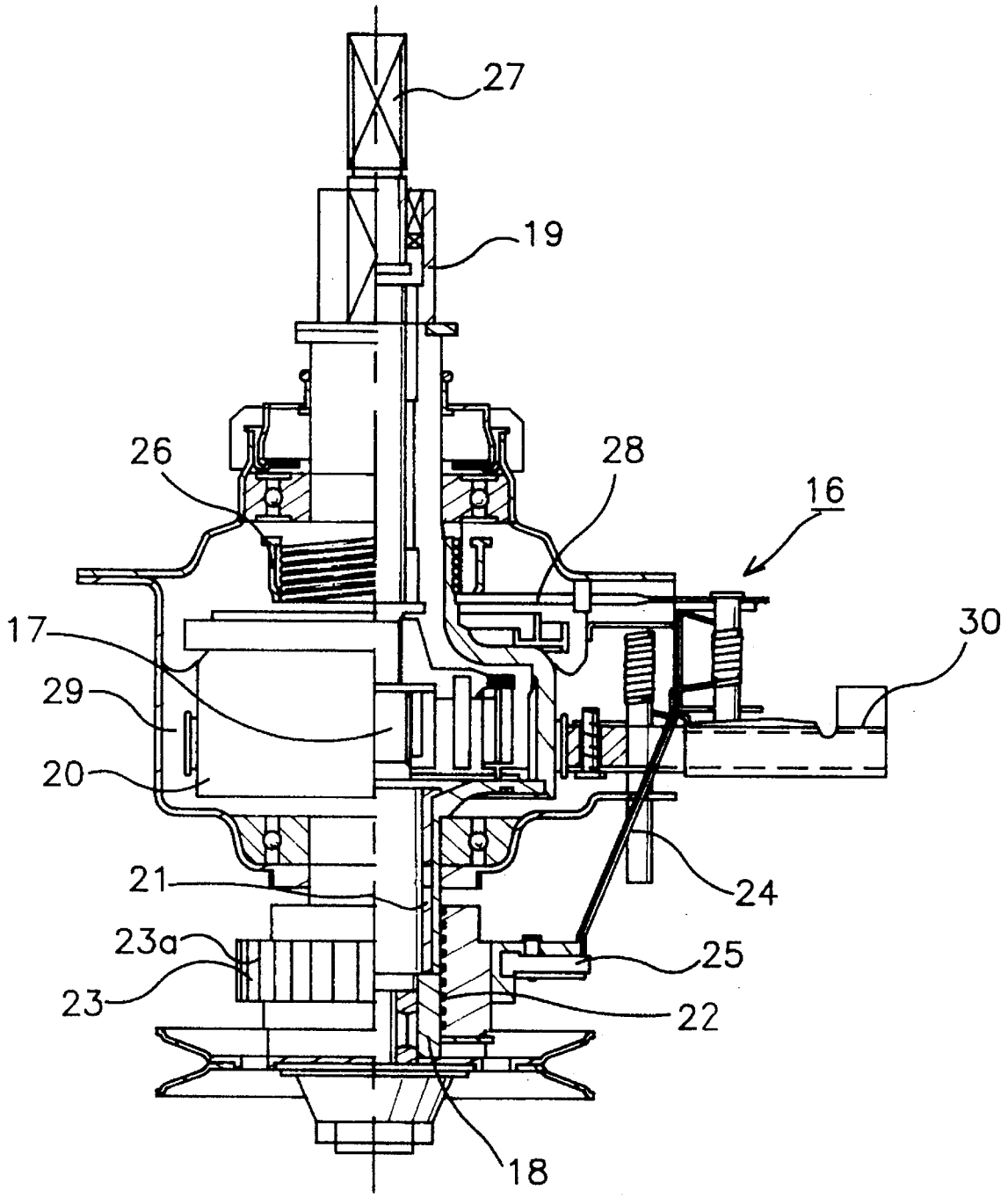
FIG.2 PRIOR ART
FIG. 2 is an enlarged sectional view showing a construction of a clutch assembly of the washing machine of FIG. 1.
Figure 3:
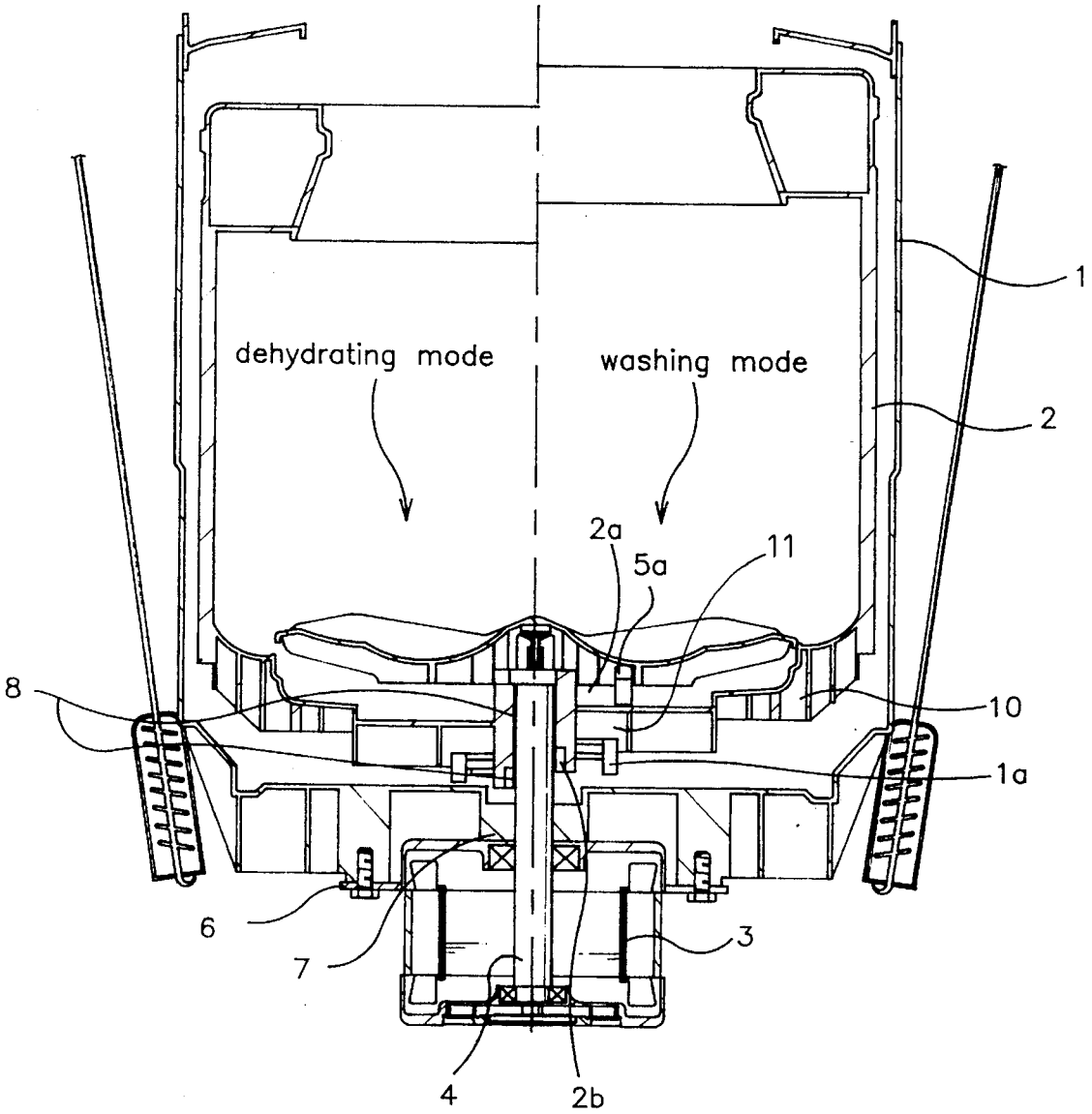
FIG. 3 is a schematic sectional view of an automatic washing machine in accordance with a primary embodiment of the present invention, showing a washing mode and a dehydrating mode of the washing machine at the same time.

With reference to FIG. 3, there is shown an automatic washing machine in accordance with a primary embodiment of the present invention. As shown in this drawing, the washing machine includes an outer tub 1 which is supported by a support bar in a cabinet or an outer casing. A washing and dehydrating tub or an inner tub 2 is rotatably concentrically placed in the outer tub 1. This inner tub 2 has a plurality of perforations (not shown) on its side wall.

In addition, a drive motor 3 is provided on an outer bottom of the outer tub 1. This drive motor 3 is included in an end bracket 6 and mounted on the outer bottom of the outer tub 1 such as by a screw. The output shaft of the drive motor 3 rotatably penetrates the bottom centers of the outer and inner tubs 1 and 2. This output shaft of the motor 3 is fixedly coupled to a rotator 5 or a pulsator at its distal end on the inner bottom of the inner tub 2. This rotator 5 is rotated by the rotational force of the motor 3 and generates water current in the inner tub 2 during a washing operation.

Since the drive motor 3 is mounted on the outer bottom center of the outer tub 1 as described above, the drive motor 3 and its output shaft 4 are assembled to the tubs 1 and 2 at the same time and the desired center of gravity of the washing machine is achieved, and the structural stability of the washing machine is achieved. In this regard, the noise and vibration generated in operation of the washing machine are remarkably reduced.

This type of washing machine is conventionally named as a washing machine of the direct driving type.

However, it should be noted that the present invention is not limited to the above washing machine of the direct driving type but may be adapted to a washing machine of the indirect driving type wherein the drive motor is mounted on the outer bottom of the outer tub at a position radially spaced apart from the bottom center and indirectly transmits its rotational force to the washing shaft through a V-belt.

When the present invention is adapted to the indirect driving type washing machine, the structural stability of the washing machine is somewhat deteriorated since a desired balance of the washing machine may be not achieved due to the drive motor radially spaced apart from the bottom center of the outer tub. However, this type of washing machine may improve the power transmission ratio between the motor shaft and the washing shaft, thus allowing a drive motor with a smaller capacity to be used as the drive motor. The indirect driving type washing machine to which the present invention is adapted will be described again in conjunction with FIG. 11.

In the primary embodiment, the washing machine is a pulsator type machine having the pulsator as the rotator 5. However, the present invention may be applied to a washing machine of the agitator type having an agitator as the rotator 5.

The washing machine of this invention also includes a sealer 7 which is provided between the upper surface of the end bracket 6 and the lower surface of the outer tub 1 for prevention of washing water leakage.

A plurality of sliding members 8, such as sliding bearings or bushes, are mounted on the outer surface of the motor shaft 4.

These sliding members 8 smoothly support ascending and descending movement of the inner tub 2 along the motor shaft 4 in a limited space between the rotator 5 and the outer tub 1 and rotation of the inner tub 2 together with the motor shaft 4.

The washing machine of this invention also includes tub clutching means which is provided between the lower surface of the rotator 5 and the-inner bottom surface of the inner tub 2 and between the outer bottom surface of the inner tub 2 and the inner bottom surface of the outer tub 1. This tub clutching means selectively couples the inner tub 2 to either of the rotator 5 and the outer tub 1 in accordance with the operational mode of the washing machine.

Figure 4:
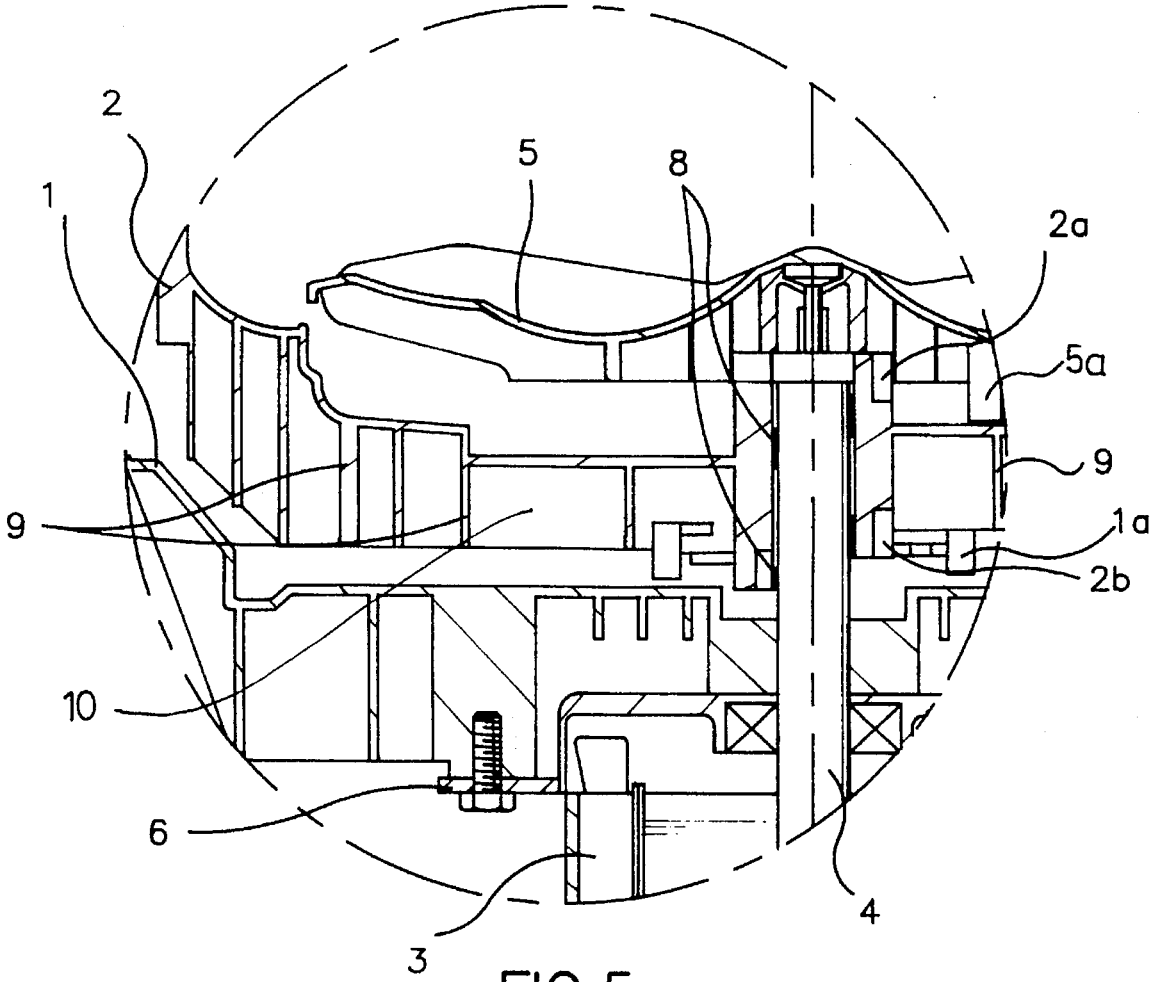
FIG. 4 is a partially enlarged sectional view of the washing machine of FIG. 3.
Figure 5:
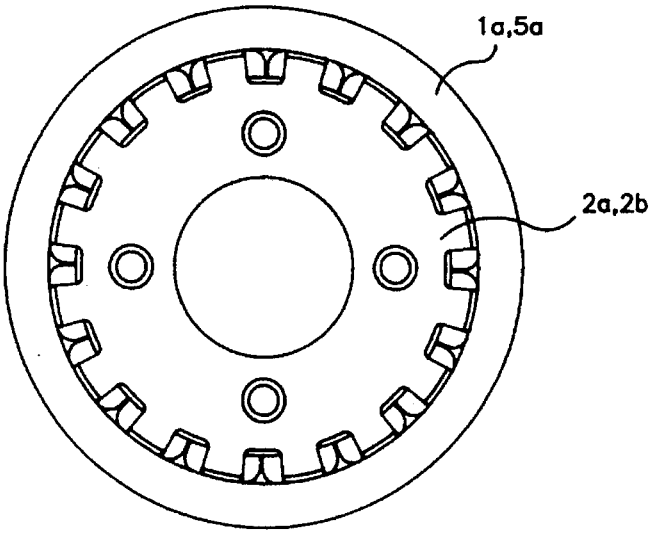
FIG. 5 is a partially enlarged plan view showing a clutched state of tub, clutching means of the washing machine of FIG. 3.

FIG. 4 is a partially enlarged sectional view of the washing machine and FIG. 5 is a partially enlarged plan view showing a clutched state of the clutching means of the washing machine. The clutching means in accordance with this embodiment comprises first and second tooth parts 2*a* and 2*b* which are formed in the bottom of the inner tub 2 such that they are vertically spaced by a predetermined distance. In addition, a third tooth part 5*a* is formed on the lower surface of the rotator 5 and engaged with the first tooth part 2*a* of the inner tub 2 when the inner tub 2 is placed in its lower position or in the dehydrating mode. The clutching means further includes a fourth tooth part la which is formed on the inner bottom surface of the outer tub 1 and engaged with the second tooth part 2*b* of the inner tub 2 when the tub 2 is placed in its upper position or in the washing mode.

In accordance with this primary embodiment of the invention, the first tooth part 2*a* and the second tooth part 2*b* of the inner tub 2 have spur gear shapes, each having square teeth which are toothed on the outer circumferential surface of a circular body. These tooth parts 2*a* and 2*b* of the inner tub 2 are vertically spaced out by the predetermined distance. In order to engage with these first and second tooth parts 2*a* and 2*b*, the third and fourth tooth parts 5*a* and 1*a* comprise internal gears, each having square teeth which are toothed on an inner circumferential surface of an annular body. The square teeth of the third and fourth tooth parts 5*a* and 1*a* are engaged with the square teeth of the first and second tooth parts 2*a* and 2*b*, respectively.

It is preferred to form the tops of the square teeth of the first to fourth tooth parts in a rounded shape such that they are smoothly engaged with the each other.

In the washing machine, inner tub floating means or buoyancy generation means is provided under the inner tub 2 in order for generation of buoyancy and for causing the ascending and descending movement of the inner tub 2 in accordance with the water level of the washing water in the outer tub 1.

In accordance with the primary embodiment, the buoyancy generation means comprises a plurality of radial ribs 9 defining a plurality of air chambers 10.

A drain tube (not shown) is provided on a side of the bottom of the of inner tub 2.

This drain tube is adapted for causing a smooth drain of washing water from the bottom of the inner tub 2 and for preventing generation of negative pressure on the lower surface of the rotator 5 in the washing operation. To prevent the generation of negative pressure is necessary in smooth pumping operation of the washing machine for collection of waste thread.

Figure 6C:
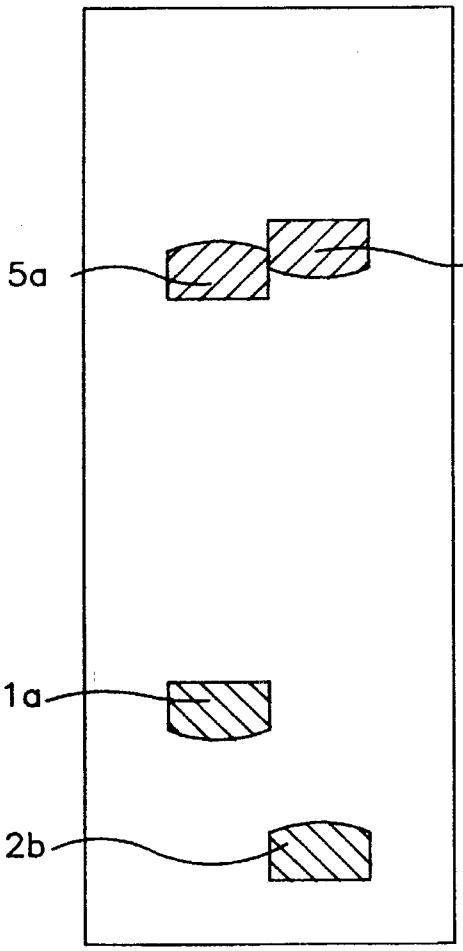

The inner tub 2 of the washing machine is placed in its lower position as shown in the left side of FIG. 3 and in FIG. 6*c* when the washing machine is not used and no washing water is charged in the outer tub 1 or this washing machine is in an initial washing mode.

At this state, the third tooth part 5*a* of the rotator 5 engages with the first tooth part 2*a* of the inner tub 2 while the second tooth part 2*b* of the inner tub 2 is separated from the fourth tooth part 1*a* of the outer tub 1.

When the drive motor 3 in this state is turned on, a dehydrating mode, wherein the rotator 5 and the inner tub 2 are simultaneously rotated at the same rotational speed, will be achieved.

The operations of the washing machine in accordance with selected operational modes are described hereinbelow in conjunction with the accompanying drawings.

Upon selection of the washing mode of the washing machine in the state of FIG. 6*c*, the drive motor 3 is initially rotated in a direction at a low speed and, at the same time, washing water is supplied to the outer tub 1.

In accordance with low speed rotation of the motor 3, the rotator 5 and the inner tub 2 are slowly rotated together. When the washing water is charged in the outer tub 1 such that it reaches a predetermined water level, the air chambers 10 of the buoyancy generation means of the inner tub 2 are filled with air. Hence, the inner tub 2 is applied with buoyancy generated by the air chambers 10 filled with the air in accordance with the water level of the washing water in the outer tub 1.

The buoyancy F generated by the buoyancy generation means is represented by the following formula.

$$F=\rho GV$$

wherein ρ is density of the washing water, G is gravitational acceleration and V is a volume of the inner tub, including the air chamber, submerged in the washing water.

When the buoyancy F applied to the inner tub 2 exceeds the gravity applied to the tub 2, the inner tub 2 ascends along the motor shaft 4.

This ascending of the inner tub 2 along the motor shaft 4 is smoothly achieved as the tub 2 is guided by the sliding members 8 provided between it and the motor shaft 4.

When the inner tub 2 is slowly rotated together with the rotator 5 and, thereafter, ascends by the buoyancy generated by the buoyancy generation means, its first tooth part 2*a* is separated from the third tooth part 5*a* of the rotator 5 while its second tooth part 2*b* is engaged with the fourth tooth part 1*a* of the outer tub 1, thus to achieve the desired washing mode.

Figure 6B:
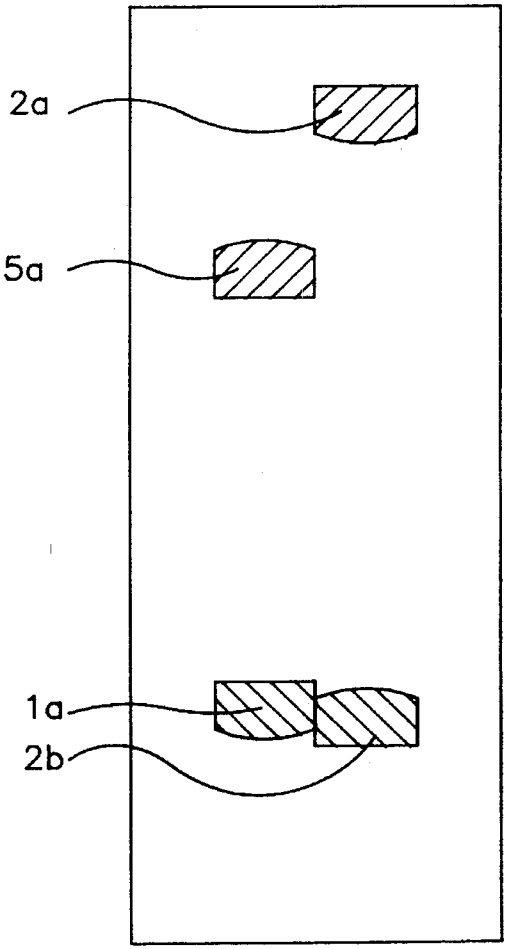
Figure 6A:
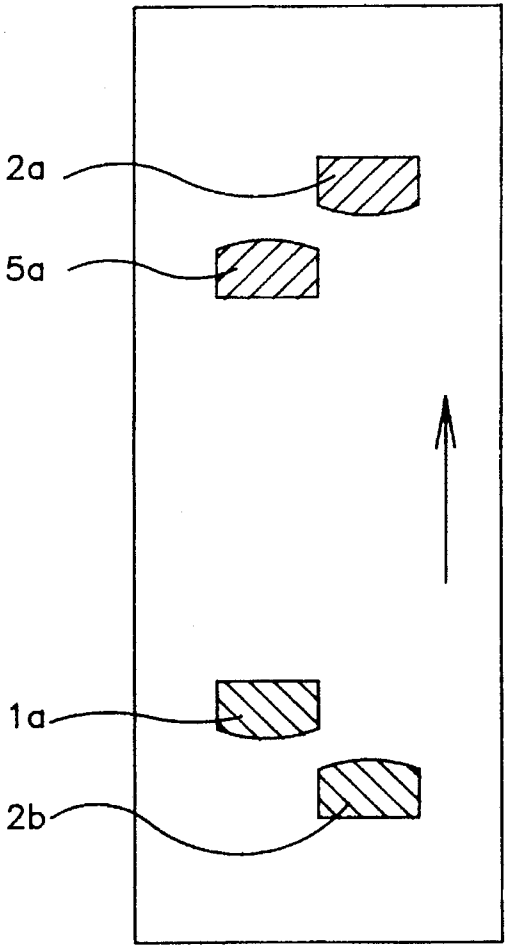

If described in detail, when the inner tub 2 ascends from its lower position, shown in the left side of FIG. 3 and in FIG. 6*c*, as shown at the arrows of the right side of FIG. 3 and of FIG. 6*a*, the first tooth part 2*a* of the inner tub 2 is separated from the third tooth part 5*a* of the rotator 5 while the second tooth part 2*b* of the inner tub 2 is engaged with the fourth tooth part 1*a* of the outer tub 1, thus to achieve the washing mode state in which the inner tub 2 is fixed to the outer tub 1 as shown in FIG. 6*b*.

In the above clutching operation for achieving the washing mode state, the first tooth part 2*a* of the inner tub 2 is smoothly separated from the third tooth part 5*a* of the rotator 5 during the ascending of the inner tub 2. However, since the second tooth part 2*b* of the inner tub 2 may be positioned with respect to the fourth tooth part 1*a* of the outer tub i that they are not directly engaged with each other, the motor 3 should be rotated at a low speed such that the inner tub 2 is slowly rotated in order to cause its second tooth part 2*b* to be correctly engaged with the fourth tooth part 1*a* of the outer tub 1.

When the operational mode is converted into the washing mode even though the above clutching operation is not completely finished, the inner tub 2 is rotated by the rotational force of the motor 3, thus to fail in the washing operation. In addition, when the clutching operation is completely finished by ascending of the inner tub 2 rotating at the low speed, the laundry in the inner tub 2 is apt to be collected to a side of the inner tub 2 by the one way rotation of the rotator 5. In order to overcome the above problems, it should be required to confirm the clutching operation when the water level reaches a predetermined level. This confirmation of the clutching operation is carried out by clutching confirmation means described later herein.

Figure 7:
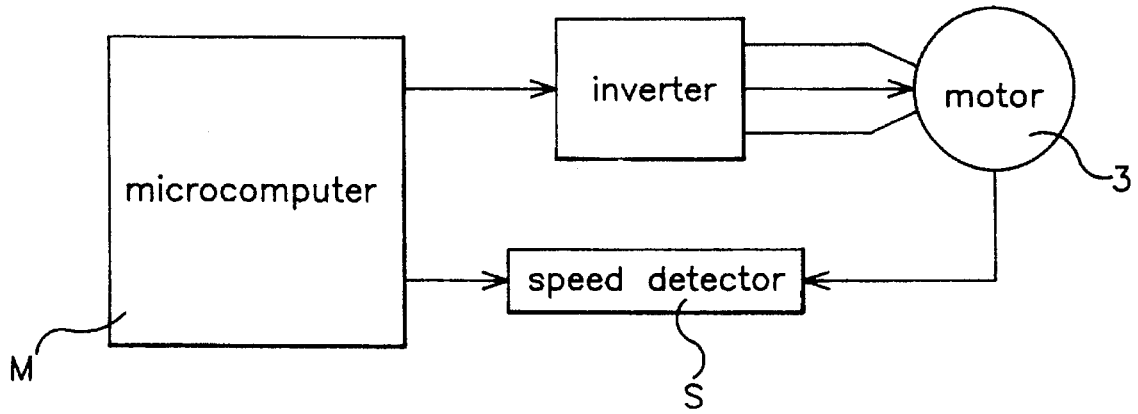
FIG. 7 is a block diagram showing a construction of a motor drive control unit of the washing machine of FIG. 3.

As shown in FIG. 7, the clutching confirmation means comprises a speed detector S for detecting a rotational speed of the drive motor 3, which speed varies in accordance with load torque generated in the clutching operation of the washing machine. This speed detector S is connected to a microcomputer M and outputs a signal representing a detected rotational speed of the drive motor 3 to the computer M. When the microcomputer M is applied with the signal of the speed detector S, it counts the driving time of the motor 3 until the detected rotational speed of the motor 3 reaches a predetermined reference speed. This computer M also applies a predetermined reference voltage to the motor 3. The microcomputer M compares the counted driving time with a predetermined reference time in order to determine which time is longer. When the counted time is longer than the reference time, the microcomputer M confirms that it has achieved the dehydrating mode, wherein the inner tub 2 is rotated together with the rotator 5 by the rotational force of the motor 3. However, when the counted time is shorter than the reference time, the microcomputer M confirms that it has achieved the washing mode, wherein only the rotator 5 is rotated by the rotational force of the motor 3.

When a voltage command value of the microcomputer M is preset as the predetermined reference voltage, the microcomputer M senses the signal of the speed detector S and drives the motor 3, and applies the reference voltage to the motor 3 until the rotational speed of the motor 3 reaches the predetermined reference speed.

Figure 8:
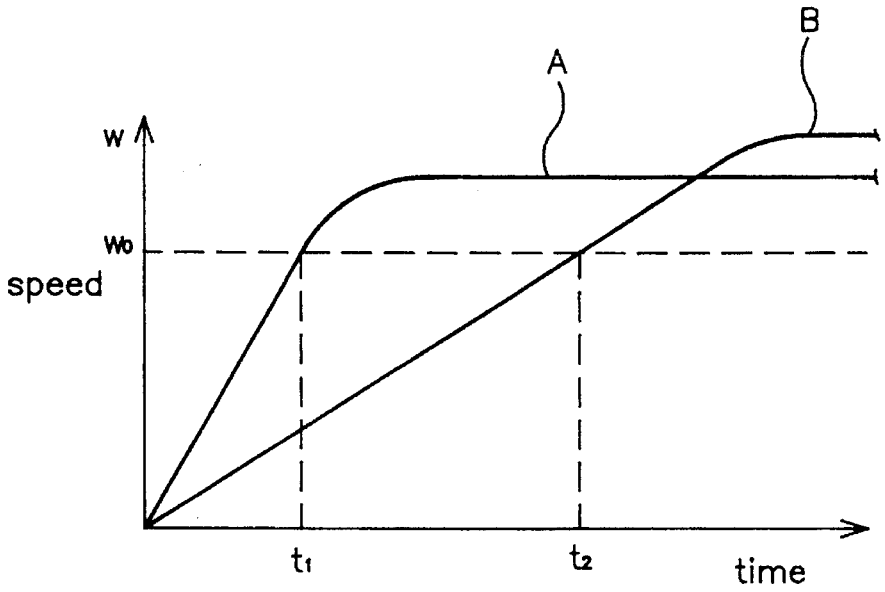
FIG. 8 is a graph showing the variation of the rotational speed of a drive motor of the washing machine of FIG. 3 with respect to lapse of time in the case of turning on the motor.

Turning to FIG. 8, there is shown a graph representing the variation of the rotational speed of the drive motor 3 with respect to a lapse of time when the motor 3 is turned on. This graph is obtained by detecting the variation of rotational speed of the drive motor 3 under the condition that the reference voltage is applied to the motor 3 and this motor 3 is turned on.

The curve A in the graph of FIG. 8 is a speed variation curve when only the rotator 5 is rotated by the rotational force of the motor 3. In this case, the rotational speed of the drive motor 3 is rapidly increased since the inertia force of the rotator 5 is very small, otherwise stated, the mechanical time constant is small.

Meanwhile, the curve B in the graph of FIG. 8 is a speed variation curve when the inner tub 2 is rotated together with the rotator 5 by the rotational force of the motor 3. In this case, the rotational speed of the drive motor 3 is very slowly increased by the same voltage command value since the inertia force of the inner tub 2 is very large, otherwise stated, the mechanical time constant is large.

Therefore, there is a prominent difference between the times $t_1$ and $t_2$ which are required for reaching the predetermined reference speed $\omega_0$, as apparent from the curves A and B of graph of FIG. 8. In this regard, it is possible to confirm, using the speed variation difference caused by the inertial force difference in starting of the motor 3, whether the clutching operation has been completely finished.

Figure 10A:
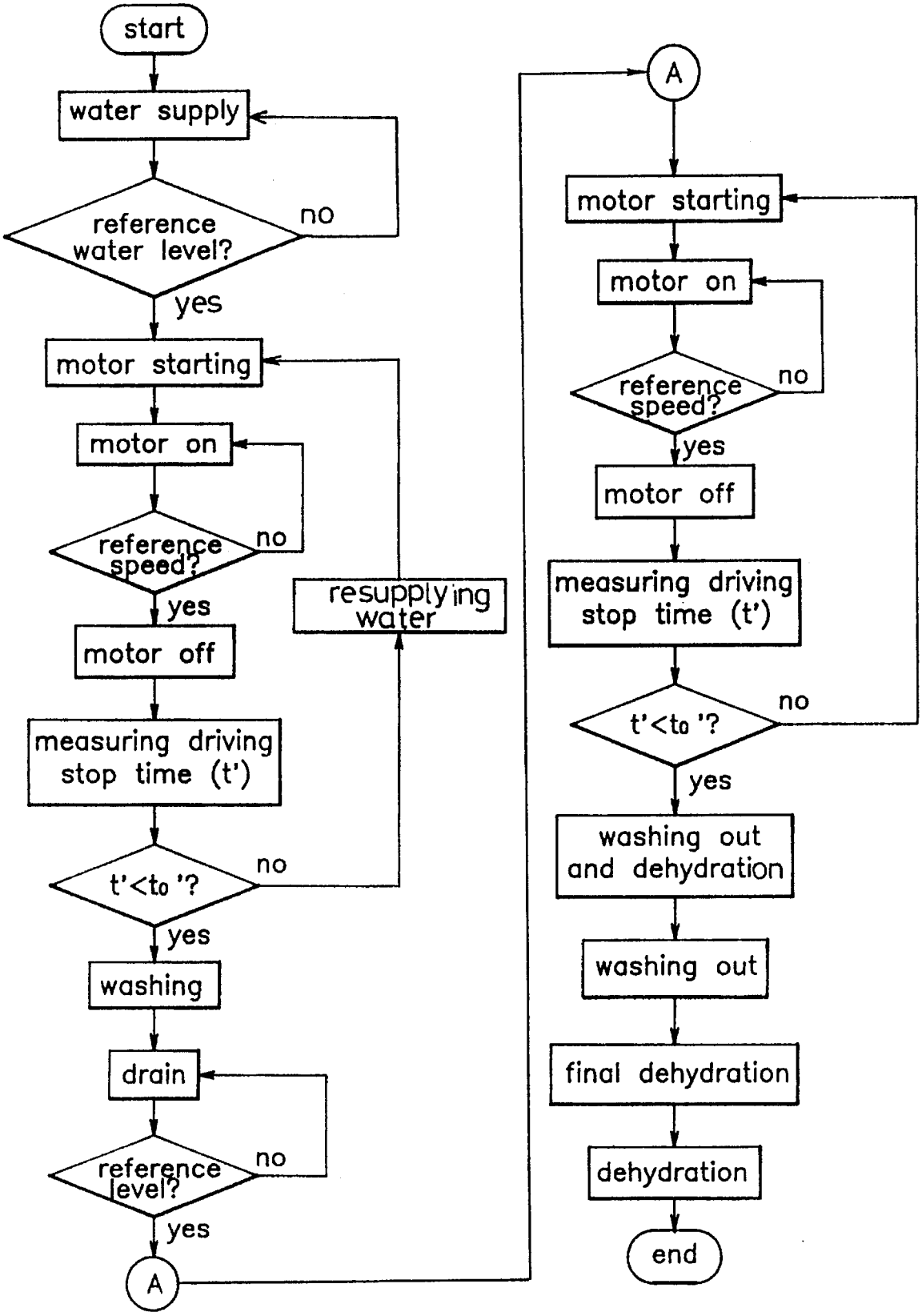
FIG. 10*a* is a flowchart of a method for confirmation of a clutching operation of the washing machine using the time of extra rotation of the motor when turning off this motor in accordance with the present invention.
Figure 10B:
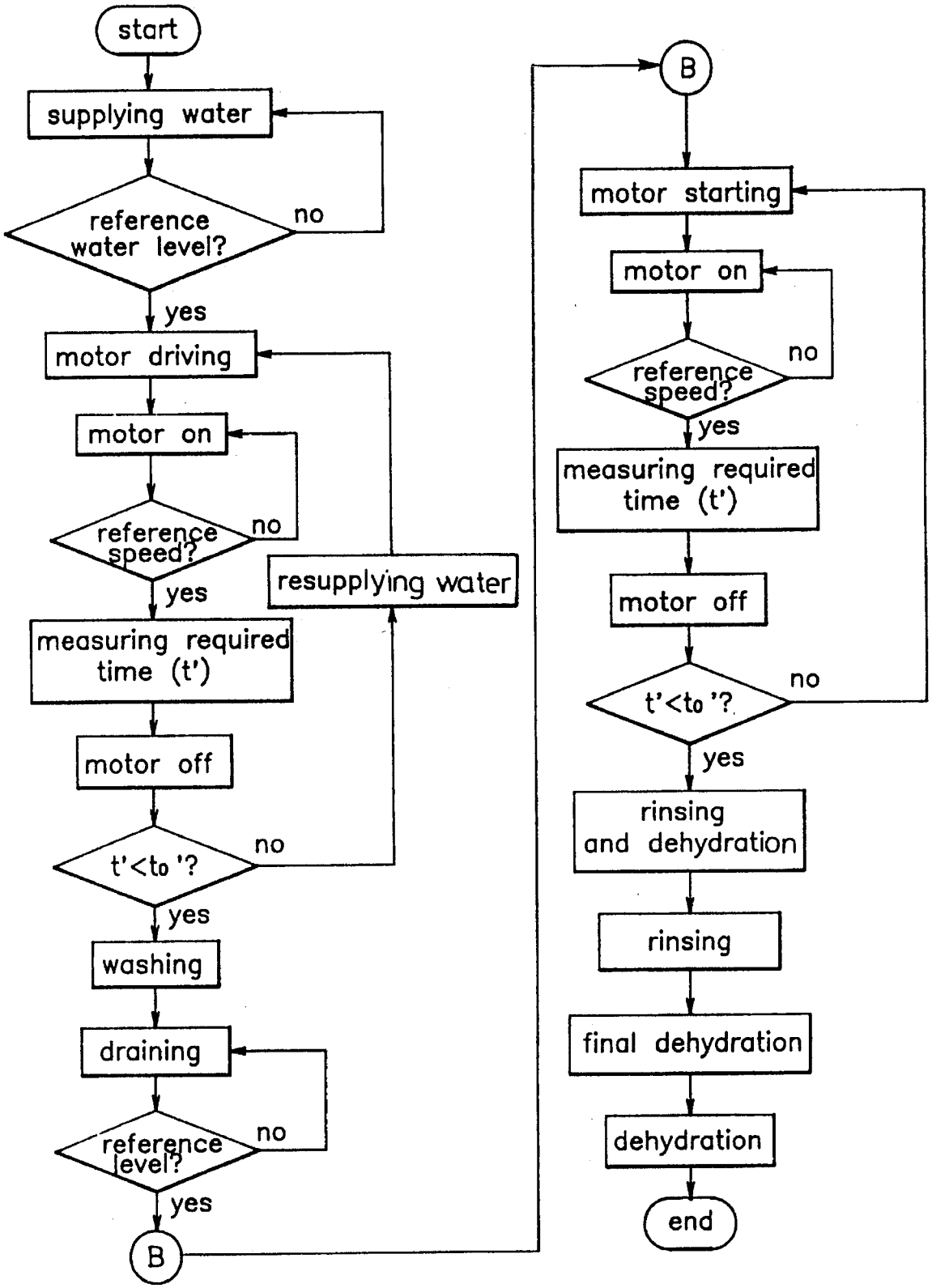
FIG. 10*b* is a flowchart of a method for confirmation of a clutching operation of the washing machine using the time to reaching a predetermined reference speed of the motor when turning on this motor in accordance with the present invention.

FIG. 10*b* is a flowchart of a method for confirmation of the clutching operation using the time to reaching the predetermined reference speed of the motor 3 when turning on this motor 3.

As represented by this flowchart, the washing water is supplied to the outer tub 1 in order to reach the predetermined water level. Upon reaching the predetermined water level, the motor 3 is started by the reference voltage and, at the same time, the motor driving time t is counted.

It is, thereafter, determined whether the rotational speed of the motor 3 has reached the reference speed. When the rotational speed of the motor 3 has reached the reference speed, the applying of reference voltage to the motor 3 and the counting of driving time t are stopped.

The counted driving time t is then compared with the reference time $t_0$, when the counted driving time is longer than the reference time, that is, $t>t_0$, it is confirmed that the it has been achieved the dehydrating mode wherein the inner tub 2 can be rotated together with the rotator 5. On the contrary, when the counted driving time is shorter than the reference time, that is, $t<t_0$, it is confirmed that it has been achieved the washing mode wherein only the rotator 5 can be rotated. In accordance with the aforementioned determination, the washing machine carries out its operational mode.

On the other hand, the microcomputer M applies the reference voltage to the motor 3 until the rotational speed of the motor 3 detected by the speed detector S reaches the predetermined reference speed. When the detected rotational speed of the motor 3 has reached the reference speed and, as a result, the reference voltage is not applied to the motor 3 any more, the computer M counts the driving stop time until the rotation of motor 3 is completely stopped.

The counted driving stop time is then compared with the reference time. When the counted stop time is longer than the reference time, it is confirmed that it has been achieved the dehydrating mode wherein the inner tub 2 can be rotated together with the rotator 5. On the contrary, when the counted stop time is shorter than the reference time, it is confirmed that it has been achieved the washing mode wherein only the rotator 5 can be rotated.

Figure 9:
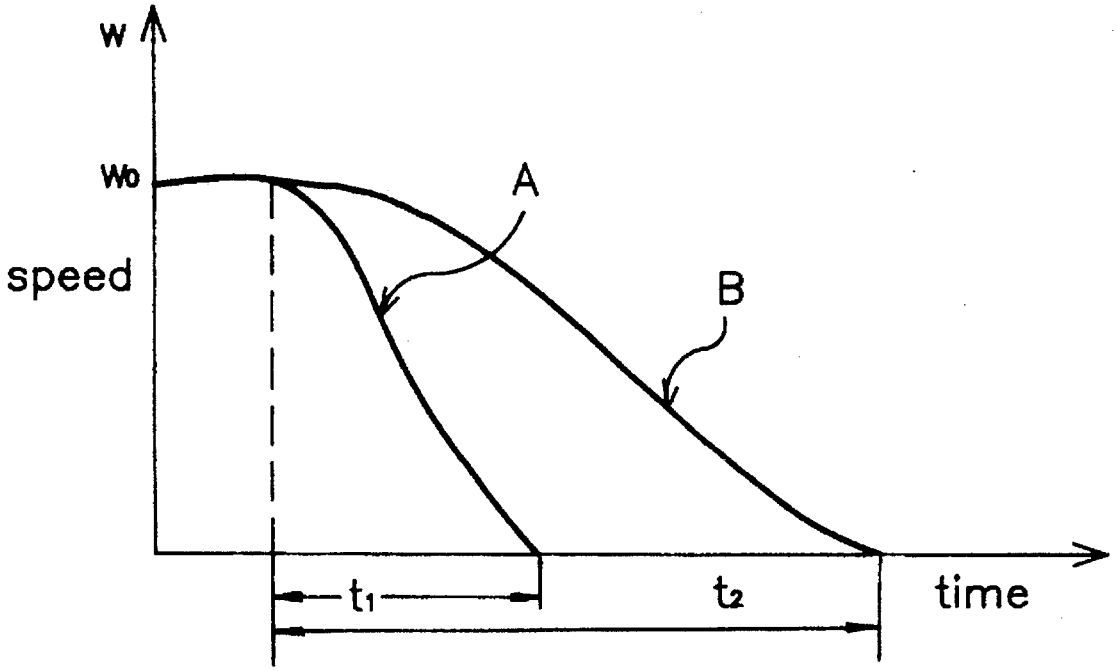
FIG. 9 is a graph showing the variation of the rotational speed of the drive motor of the washing machine of FIG. 3 with respect to lapse of time in the case of turning off the motor.

Hence, the present invention can provide a method for confirmation of the clutching operation using the inertia force difference between the inner tub 2 and the rotator 5 as shown in FIGS. 9 and 10*a*.

FIG. 9 is a graph representing the variation of the rotational speed of the drive motor 3 with respect to lapse of time in the case of turning off the motor 3. As represented in this graph, the predetermined reference voltage is applied to the motor 3 until the rotational speed of the motor 3 reaches the predetermined reference speed $\omega_0$. When the rotational speed of the motor 3 reaches the reference speed, the reference voltage is not applied to the motor 3 any more and the driving stop time until the rotation of motor 3 is completely stopped is counted by the microcomputer M. As apparent from the graph, the counted driving stop time is differentiated in accordance with operational mode of the washing machine. That is, the driving stop time is relatively shorter in the case of the curve A representing that only the rotator 5 is rotated, while the driving stop time is relatively longer in the case of the curve B representing that the rotator 5 and the inner tub 2 are rotated together. Hence, it is possible to confirm, using the speed variation difference caused by the inertial force difference in stopping the motor 3, whether the clutching operation has been completely finished.

FIG. 10*a* is a flowchart of a method for confirmation of the clutching operation using the time of extra rotation of the motor 3 when stopping this motor 3.

As represented by this flowchart, the washing water is supplied to the outer tub 1 in order to reach the predetermined water level. Upon reaching the predetermined water level, the motor 3 is started by the reference voltage. When the rotational speed of the motor 3 reaches the reference speed, the reference voltage is not applied to the motor 3 any more and the driving stop time t' until the rotation of motor 3 is completely stopped is counted by the microcomputer M.

When the rotation of motor 3 is completely stopped, the counted driving stop time t' is compared with the reference time $t_0'$. When the counted driving time is longer than the reference time, that is, $t'>t_0'$ it is confirmed that it has been achieved the dehydrating mode wherein the inner tub 2 can be rotated together with the rotator 5. On the contrary, when the counted driving stop time is shorter than the reference time, that is, $t'<t_0'$ it is confirmed that it has been achieved the washing mode wherein only the rotator 5 can be rotated. In accordance with the aforementioned determination, the washing machine carries out its operational mode.

upon confirmation of the clutching operation, the washing water is further supplied to the outer tub 1 in order to reach a predetermined washing mode water level. The rotator 5 fixed to the motor shaft 4 is rotated in opposed directions in accordance with opposed directional rotation of the motor 3, thus to generate water current in the inner tub 2 and to carry out the desired washing operation.

In this washing mode, the inner tub 2 is applied with a rotational force caused by both the friction between the washing water and the laundry and the water current, so that it tends to be rotated. However, in accordance with the present invention, the inner tub 2 is reliably prevented from rotation since its second tooth part 2*b* is engaged with the fourth tooth part la of the stationary outer tub 1.

Upon starting the dehydrating operation of the washing machine after the above washing operation, a drain valve (not shown) provided on the lower section of the outer tub 1 is opened such as by a solenoid or a drain motor, thus to drain the washing water from the outer tub 1. As the washing water is somewhat drained from the outer tub 1, the inner tub 2 descends in a manner reversed to the aforementioned manner of the ascending of the inner tub 2.

That is, when the washing water is gradually reduced in its level as a result of draining, the volume of the inner tub 2 submerged in the washing water is reduced, thus to reduce the buoyancy applied to the inner tub 2.

When the buoyancy applied to the inner tub 2 becomes smaller than the gravity applied to the same tub 2, the inner tub 2 slides down along the motor shaft 4, thus to descend to its lower position.

In accordance with the descending of the inner tub 2 along the motor shaft 4, the second tooth part 2*b* of the inner tub 2 is separated from the fourth tooth part 1*a* of the outer tub 1, while the first tooth part 2*a* of the inner tub 2 is engaged with the third tooth part 5*a* of the rotator 5.

Otherwise stated, the inner tub 2 is coupled to the rotator 5 other than the outer tub 1 and, at this state, the inner tub 2 and the rotator 5 transmit their rotational torques to each other through their tooth parts 2*a* and 5*a* engaged with each other, thus to be rotated together at a high speed and to carry out the desired dehydrating operation.

In this case, since the first tooth part 2*a* of the inner tub 2 may be positioned with respect to the third tooth part 5*a* of the rotator 5 that they are not directly engaged with each other, the motor 3 should be rotated at a low speed such that the rotator 5 is slowly rotated in order to cause its third tooth part 5*a* to be correctly engaged with the first tooth part 2*a* of the inner tub 2. Here, since the inner tub 2 has a relatively heavy weight, it may be applied with a serious mechanical shock when it freely falls, under the condition of no water in the outer tub 1, in order to engage its first tooth part 2*a* with the third tooth part 5*a* of the rotator 5.

In order to prevent the mechanical shock applied to the inner tub 2 during the engagement of the tooth parts 2*a* and 5*a*, the washing machine of the present invention carries out the engagement of the tooth parts 2*a* and 5*a* under the condition that some quantity of washing water remains in the outer tub 2. The mechanical shock is damped by the water.

When the microcomputer M does not determined that the clutching has been finished, the washing water is supplied to the outer tub 1 until it reaches a predetermined maximum level irrespective of quantity of the laundry in the inner tub 2. In addition, when the clutching is not confirmed by the microcomputer M even when the washing water has reached the maximum level, the washing operation of the washing machine is not started.

Figure 11:
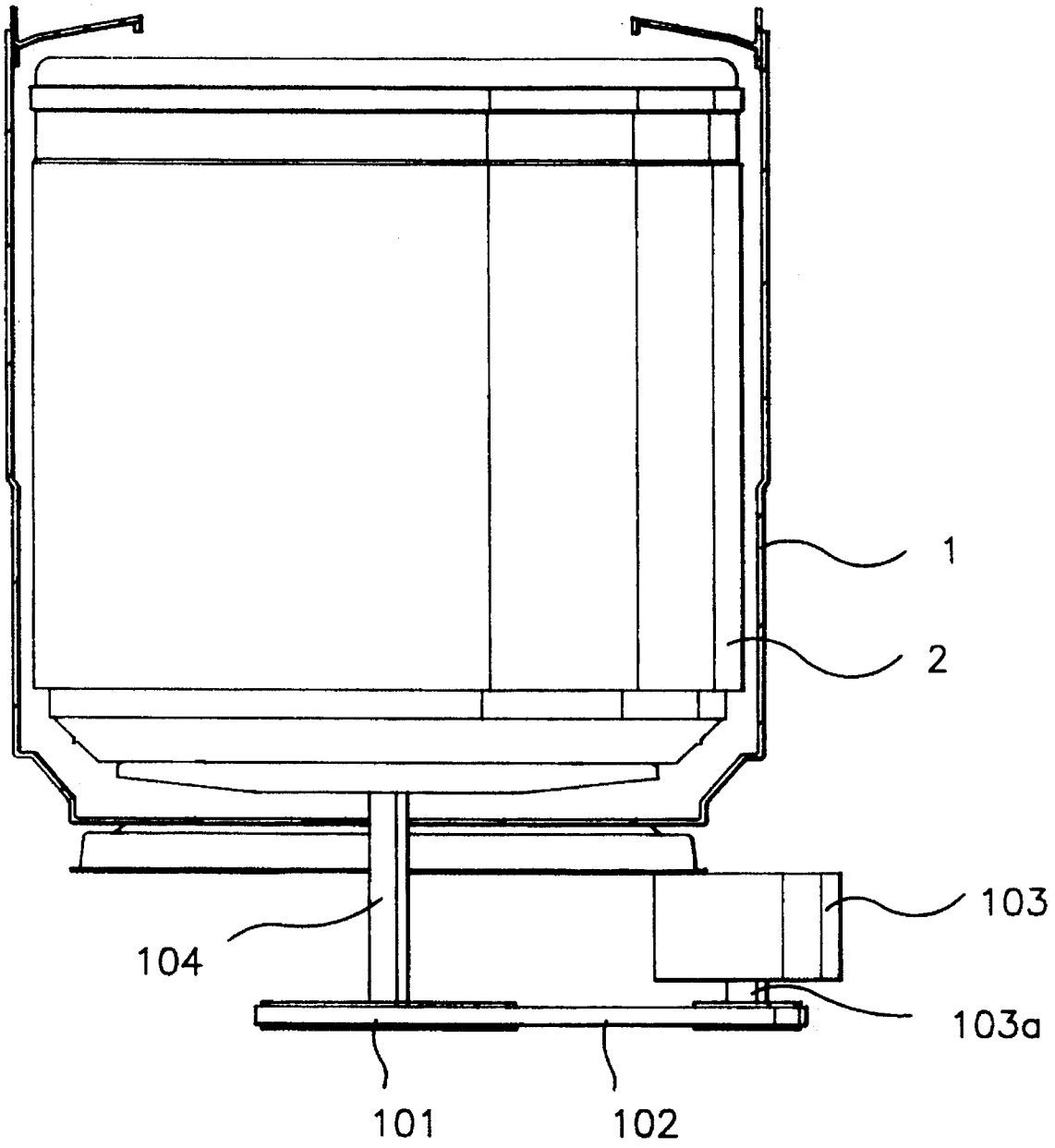
FIG. 11 is a schematic view of an automatic washing machine in accordance with a second embodiment of the present invention.

Turning to FIG. 11, there is shown an automatic washing machine in accordance with a second embodiment of the present invention. In this embodiment, the general shape and the operational effect remain the same as described for the primary embodiment, but the location of the drive motor is changed such that the rotational force of the drive motor is indirectly transmitted to the washing shaft. That is, the drive motor 103 is not mounted on the outer bottom center of the outer tub but is mounted on the outer bottom of the outer tub 1 at a position spaced apart from the bottom center. The motor 103 indirectly transmits its rotational force to a washing shaft 104 through a transmission belt 102 wrapped about an output shaft 103*a* of the motor 103 and a pulley 101 of the washing shaft 104. Here, the washing shaft 104 is provided with the rotator 5 on its top end. Otherwise stated, in this embodiment, the present invention is adapted to a washing machine of the indirect driving type.

When the present invention is adapted to the indirect driving type washing machine as shown in FIG. 11, the structural stability of the washing machine is somewhat deteriorated since a desired balance of the washing machine may be not achieved due to the drive motor radially spaced apart from the bottom center of the outer tub. However, this second embodiment may improve or increase the power transmission ratio between the motor shaft 103*a* and the washing shaft 104, thus to allow a drive motor of a relatively smaller capacity to be used as the motor 103.

As described above, an automatic washing machine in accordance with the present invention lifts or lowers the inner tub using buoyancy caused by washing water or the weight of the inner tub in order to couple this inner tub to the outer tub or the rotator, thus to achieve the washing mode or the dehydrating mode and to selectively transmit the rotational force of the drive motor to the inner tub without using the conventional complex clutch assembly. When the washing water supplied to the outer tub reaches a predetermined water level, the drive motor is slowly rotated in opposed directions in order to correctly engage a spur gear type tooth part of the inner tub with a corresponding tooth part of the rotator or of the outer tub and to smoothly achieve a desired tub clutching.

In the washing machine of the present invention, the washing machine of the present invention carries out the engagement of the tooth parts under the condition that some quantity of washing water remains in the outer tub. The remaining the mechanical shock applied to the inner tub during the engagement of the tooth parts.

The washing machine drive motor is mounted on the outer bottom center of the outer tub to achieve the desired structural stability. This mounting structure of the motor also reduces the noise and vibration generated in operation of the washing machine.

Another advantage of this washing machine is that it has a simple construction and is easily fabricated. The simple construction of this washing machine also reduces the number of parts which prevents operational trouble and improves the reliability of the washing machine.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the following claims.

What is claimed is:

1. An automatic washing machine, comprising:

an outer tub for containing washing water therein;

a movable inner tub for washing and dehydration, said inner tub being movably concentrically placed in said outer tub in order to ascend and descend and having a plurality of perforations on its side wall;

means for generating buoyancy in accordance with a water level of washing water charged in said outer tub, said buoyancy being applied to said inner tub in order to cause said inner tub to ascend;

a shaft rotatably penetrating bottom centers of both the outer tub and the inner tub and guiding the ascending and descending of said inner tub;

motor means for generating a rotational force for rotating said shaft;

means for generating a water current using the rotational force of said motor means, said water current generating means being mounted on a top end of said shaft; and clutching means for selectively coupling said inner tub to one of said outer tub and said water current generating means in accordance with said position of said inner tub ascending and descending under the guide of said shaft wherein said clutching means comprises:

a first tooth part formed on an upper section of a bottom of said inner tub;

a second tooth part formed on a lower section of the bottom of said inner tub;

a third tooth part formed on a lower surface of said water current generating means and being engaged with said first tooth part when said inner tub completely descends; and a fourth tooth part formed on a n inner bottom surface of said outer tub and being engaged with said second tooth part when said inner tub completely ascends.

2. The automatic washing machine as claimed in claim 1, further comprising a sliding member mounted on an outer surface of said shaft in order for minimizing a frictional force between said shaft and said inner tub during the ascending and descending of said inner tub along said shaft.

3. The automatic washing machine as claimed in claim 1, wherein tops of teeth of said first to fourth tooth parts are rounded in shape so that they are adapted to be smoothly engaged with each other.

4. An automatic washing machine, comprising:

an outer tub for containing washing water therein;

a movable inner tub for washing and dehydration, said inner tub being movably concentrically placed in said outer tub in order to ascend and descend and having a plurality of perforations on its side wall;

means for generating buoyancy in accordance with a water level of washing water charged in said outer tub, said buoyancy being applied to said inner tub in order to cause said inner tub to ascend;

a shaft rotatably penetrating bottom centers of both the outer tub and the inner tub and guiding the ascending and descending of said inner tub;

motor means for generating a rotational force for rotating said shaft;

means for generating a water current using the rotational force of said motor means, said water current generating means being mounted on a top end of said shaft;

clutching means for selectively coupling said inner tub to one of said outer tub and said water current generating means in accordance with said position of said inner tub ascending and descending under the guide said shaft; and means for confirming whether a clutching operation for selectively coupling said inner tub to one of said outer tub and said water current generating means has been completely finished;

wherein said clutching operation confirming means comprises:

means for detecting a rotational speed of said motor means; and a microcomputer connected to said detecting means, said microcomputer applying a predetermined reference voltage to said motor means while counting a time until said rotational speed of the motor means reaches a predetermined reference speed, thereafter, comparing the counted time with a predetermined reference time, and confirming a dehydrating mode, wherein said water current generating means and said inner tub have been coupled to each other in order to be rotated together, when determining said counted time longer than said reference time, however, confirming a washing mode, wherein said inner tub has been coupled to said outer tub and only the water current generating means is rotated, when determining said counted time shorter than said reference time.

5. An automatic washing machine, comprising:

an outer tub for containing washing water therein;

a movable inner tub for washing and dehydration, said inner tub being movably concentrically placed in said outer tub in order to ascend and descend and having a plurality of perforations on its side wall;

means for generating buoyancy in accordance with a water level of washing water charged in said outer tub, said buoyancy being applied to said inner tub in order to cause said inner tub to ascend;

a shaft rotatably penetrating bottom centers of both the outer tub and the inner tub and guiding the ascending and descending of said inner tub;

motor means for generating a rotational force for rotating said shaft;

means for generating a water current using the rotational force of said motor means, said water current generating means being mounted on a top end of said shaft;

clutching means for selectively coupling said inner tub to one of said outer tub and said water current generating means in accordance with said position of said inner tub ascending and descending under the guide of said shaft; and means for confirming whether a clutching operation for selectively coupling said inner tub to one of said outer tub and said water current generating means has been completely finished;

wherein said clutching operation confirming means comprises:

means for detecting a rotational speed of said motor means; and a microcomputer connected to said detecting means, said microcomputer applying a predetermined reference voltage to said motor means until said rotational speed of the motor means reaches a predetermined reference speed, counting a time until the rotation of said motor means is completely stopped when said reference voltage is not applied to said motor means any more since said rotational speed of the motor means has reached said reference speed, thereafter, comparing the counted time with a predetermined reference time, and confirming a dehydrating mode, wherein said water current generating means and said inner tub have been coupled to each other in order to be rotated together, when determining said counted time longer than said reference time, however, confirming a washing mode, wherein said inner tub has been coupled to said outer tub and only the water current generating means is rotated, when determining said counted time shorter than said reference time.

6. An automatic washing machine, comprising:

an outer tub for containing washing water therein;

a movable inner tub for washing and dehydration, said inner tub being movably concentrically placed in said outer tub in order to ascend an descend and having a plurality of perforations on its side wall;

means for generating buoyancy in accordance with a water level of washing water charged in said outer tub, said buoyancy being applied to said inner tub in order to cause said inner tub to ascend;

a shaft rotatably penetrating a center of a bottom of each of the outer tub and the inner tub, said shaft guiding the ascending and descending of said inner tub;

motor means for generating a rotational force for rotating said shaft, said motor means being mounted on an outer bottom of said outer tub such that it is eccentric from said shaft;

means for transmitting a rotational force of said motor means to said shaft;

means for generating a water current using the rotational force of said motor means, said water current generating means being mounted on a top end of said shaft; and clutching means for selectively coupling said inner tub to one of said outer tub and said water current generating means in accordance with a position of said inner tub ascending and descending under the guide of said shaft;

wherein said clutching means comprises:

a first tooth part formed on an upper section of the bottom of said inner tub;

a second tooth part formed on a lower section of the bottom of said inner tub;

a third part formed on a lower surface of said water current generating means and being engaged with said first tooth part when said inner tub completely descends; and a fourth tooth part formed on an inner bottom surface of said outer tub and being engaged with said second tooth part when said inner tub completely ascends.

7. The automatic washing machine as claimed in claim 6, wherein tops of teeth of said first to fourth tooth parts are rounded in shape so that they are adapted to be smoothly engaged with each other.

8. An automatic washing machine, comprising:

an outer tub for containing washing water therein;

a movable inner tub for washing and dehydration, said inner tub being movably concentrically placed in said outer tub in order to ascend an descend and having a plurality of perforations on its side wall;

means for generating buoyancy in accordance with a water level of washing water charged in said outer tub, said buoyancy being applied to said inner tub in order to cause said inner tub to ascend;

a shaft rotatably penetrating a center of a bottom of each of the outer tub and the inner tub, said shaft guiding the ascending and descending of said inner tub;

motor means for generating a rotational force for rotating said shaft, said motor means being mounted on an outer bottom of said outer tub such that it is eccentric from said shaft;

means for transmitting a rotational force of said motor means to said shaft;

means for generating a water current using the rotational force of said motor means, said water current generating means being mounted on a top end of said shaft;

clutching means for selectively coupling said inner tub to one of said outer tub and said water current generating means in accordance with a position of said inner tub ascending and descending under the guide of said shaft; and means for confirming whether a clutching operation for selectively coupling said inner tub to one of said outer tub and said water current generating means has been completely finished;

wherein said clutching operation means comprises:

means for detecting a rotational speed of said motor means; and a microcomputer connected to said detecting means, said microcomputer applying a predetermined reference voltage to said motor means while counting a time until said rotational speed of the motor means reaches to a predetermined reference speed, thereafter, comparing the counted time with a predetermined reference time, and confirming a dehydrating mode, wherein said water current generating means and said inner tub have been coupled to each other in order to be rotated together, when determining said counted time longer than said reference time, however, confirming a washing mode, wherein said inner tub has been coupled to said outer tub and only the water current generating means is rotated, when determining said counted time shorter than said reference time.

9. An automatic washing machine, comprising:

an outer tub for containing washing water therein;

a movable inner tub for washing and dehydration, said inner tub being movably concentrically placed in said outer tub in order to ascend an descend and having a plurality of perforations on its side wall;

means for generating buoyancy in accordance with a water level of washing water charged in said outer tub, said buoyancy being applied to said inner tub in order to cause said inner tub to ascend;

a shaft rotatably penetrating a center of a bottom of each of the outer tub and the inner tub, said shaft guiding the ascending and descending of said inner tub;

motor means for generating a rotational force for rotating said shaft, said motor means being mounted on an outer bottom of said outer tub such that it is eccentric from said shaft;

means for transmitting a rotational force of said motor means to said shaft;

means for generating a water current using the rotational force of said motor means, said water current generating means being mounted on a top end of said shaft;

clutching means for selectively coupling said inner tub to one of said outer tub and said water current generating means in accordance with a position of said inner tub ascending and descending under the guide of said shaft; and means for confirming whether a clutching operation for selectively coupling said inner tub to one of said outer tub and said water current generating means has been completely finished;

wherein said clutching operation confirming means comprises:

means for detecting a rotational speed of said motor means; and a microcomputer connected to said detecting means, said microcomputer applying a predetermined reference voltage to said motor means until said rotational speed of the motor means reaches to a predetermined reference speed, counting a time until the rotation of said motor means is completely stopped when said reference voltage is not applied to said motor means any more since said rotational speed of the motor means has reached said reference speed, thereafter, comparing the counted time with a predetermined reference time, and confirming a dehydrating mode, wherein said water current generating means and said inner tub have been coupled to each other in order to be rotated together, when determining said counted time longer than said reference time, however, confirming a washing mode, wherein said inner tub has been coupled to said outer tub and only the water current generating means is rotated, when determining said counted time shorter than said reference time.

* * * * *